US012509974B2

(12) United States Patent
Christinzio et al.

(10) Patent No.: US 12,509,974 B2
(45) Date of Patent: Dec. 30, 2025

(54) SYSTEMS AND METHODS FOR FLUID END HEALTH MONITORING

(71) Applicant: U.S. Well Services, LLC, Houston, TX (US)

(72) Inventors: Alexander Christinzio, Houston, TX (US); Arden Albert, Calgary (CA); Lon Robinson, Houston, TX (US); Jared Oehring, Houston, TX (US)

(73) Assignee: U.S. WELL SERVICES, LLC, Willow Park, TX (US)

( * ) Notice: Subject to any disclaimer, the term of this patent is extended or adjusted under 35 U.S.C. 154(b) by 0 days.

(21) Appl. No.: 17/134,880

(22) Filed: Dec. 28, 2020

(65) Prior Publication Data

US 2021/0198992 A1 Jul. 1, 2021

Related U.S. Application Data

(60) Provisional application No. 62/954,214, filed on Dec. 27, 2019.

(51) Int. Cl.

| | |
|---|---|
| ***E21B 43/26*** | (2006.01) |
| ***E21B 47/06*** | (2012.01) |
| ***E21B 49/08*** | (2006.01) |

(52) U.S. Cl.

CPC ..... *E21B 43/26* (2013.01); *E21B 47/06* (2013.01); *E21B 49/0875* (2020.05)

(58) Field of Classification Search

CPC ..... E21B 43/26; E21B 47/06; E21B 49/0875; E21B 43/2607

See application file for complete search history.

(56) References Cited

U.S. PATENT DOCUMENTS 1,541,601 A 6/1925 Tribe
1,743,771 A 1/1930 Hall et al.
(Continued)

FOREIGN PATENT DOCUMENTS

CN 104117308 A 10/2014
CN 104196613 A 12/2014
(Continued)

OTHER PUBLICATIONS

Kroposki et al., Making Microgrids Work, 6 IEEE Power and Energy Mag. 40, 41 (2008).
(Continued)

*Primary Examiner* — Alexander Satanovsky
(74) *Attorney, Agent, or Firm* — Abel Schillinger, LLP

(57) ABSTRACT

A method of hydraulic fracturing includes providing a fracturing fluid to a pump. The pump includes a pressure sensor for measuring pressure at a fluid end. The method further include injecting the fracturing fluid from the pump into a wellhead via the fluid end, obtaining a first pressure measurement at a discharge side of the fluid end via the pressure sensor, obtaining a second pressure measurement at the discharge side of the fluid end via the pressure sensor, determining a pressure differential between the first pressure measurement and the second pressure measurement, and determining an operational condition of the fluid end based at least in part on the pressure differential and a known or estimated correlation between the pressure differential and the operational condition.

10 Claims, 5 Drawing Sheets

(56) References Cited

U.S. PATENT DOCUMENTS 1,967,466 A 7/1934 Damsel
2,237,812 A 4/1941 De Blieux et al.
2,753,940 A 7/1956 Bonner
2,852,600 A 9/1958 Jenkins, Jr.
2,976,025 A 3/1961 Pro
3,116,086 A 12/1963 Barengoltz
3,347,570 A 10/1967 Roessler
3,794,846 A 2/1974 Schlicher et al.
3,878,884 A 4/1975 Raleigh
3,967,841 A 7/1976 Kendrick et al.
4,411,313 A 10/1983 Johnson et al.
4,442,665 A 4/1984 Fick et al.
4,538,916 A 9/1985 Zimmerman
4,562,360 A 12/1985 Fujimoto
4,601,629 A 7/1986 Zimmerman
4,768,884 A 9/1988 Elkin
4,783,038 A 11/1988 Gilbert et al.
4,898,473 A 2/1990 Stegemoeller et al.
5,114,239 A 5/1992 Allen
5,293,947 A 3/1994 Stratton
5,334,899 A 8/1994 Skybyk
5,439,066 A 8/1995 Gipson
5,486,047 A 1/1996 Zimmerman
5,549,285 A 8/1996 Collins
5,679,894 A * 10/1997 Kruger ..... E21B 47/06 73/152.01
5,791,636 A 8/1998 Loziuk
5,798,596 A 8/1998 Lordo
5,813,455 A 9/1998 Pratt et al.
5,894,888 A 4/1999 Wiemers et al.
5,950,726 A 9/1999 Roberts
6,035,265 A 3/2000 Dister et al.
6,097,310 A 8/2000 Harrell et al.
6,116,040 A 9/2000 Stark
6,121,705 A 9/2000 Hoong
6,273,193 B1 8/2001 Hermann et al.
6,315,523 B1 11/2001 Mills
6,406,011 B1 6/2002 Kosar et al.
6,442,942 B1 9/2002 Kopko
6,510,695 B1 1/2003 Fisher
6,585,455 B1 7/2003 Petersen et al.
6,633,727 B2 10/2003 Henrie et al.
6,788,022 B2 9/2004 Sopko
6,808,303 B2 10/2004 Fisher
6,837,910 B1 1/2005 Yoshikawa et al.
6,985,750 B1 1/2006 Vicknair et al.
7,279,655 B2 10/2007 Blutke et al.
7,309,835 B2 12/2007 Morrison et al.
7,341,287 B2 3/2008 Gibb et al.
7,494,263 B2 2/2009 Dykstra et al.
7,717,193 B2 5/2010 Egilsson et al.
7,770,396 B2 8/2010 Roby et al.
7,795,830 B2 9/2010 Johnson
7,807,048 B2 10/2010 Collette
7,845,413 B2 12/2010 Shampine et al.
7,900,893 B2 3/2011 Teurlay et al.
8,146,665 B2 4/2012 Neal
8,221,513 B2 7/2012 Ariyapadi et al.
8,272,439 B2 9/2012 Strickland
RE44,444 E 8/2013 Dole et al.
8,556,302 B2 10/2013 Dole
8,774,972 B2 7/2014 Rusnak et al.
8,789,601 B2 7/2014 Broussard et al.
8,893,787 B2 11/2014 Tips et al.
8,905,056 B2 12/2014 Kendrick
8,997,904 B2 4/2015 Cryer et al.
9,062,545 B2 6/2015 Roberts et al.
9,140,105 B2 9/2015 Pattillo
9,140,110 B2 9/2015 Coli et al.
9,353,593 B1 5/2016 Lu et al.
9,410,410 B2 8/2016 Broussard et al.
9,450,385 B2 9/2016 Kristensen
9,475,840 B2 10/2016 Lledóet al.
9,506,333 B2 11/2016 Castillo et al.
9,611,728 B2 4/2017 Oehring
9,790,858 B2 10/2017 Kanebako
9,893,500 B2 2/2018 Oehring et al.
9,903,190 B2 2/2018 Conrad et al.
9,945,365 B2 4/2018 Hernandez et al.
9,970,278 B2 5/2018 Broussard et al.
10,020,711 B2 7/2018 Oehring et al.
10,119,381 B2 11/2018 Oehring et al.
10,221,639 B2 3/2019 Romer et al.
10,254,732 B2 4/2019 Oehring et al.
10,280,724 B2 5/2019 Hinderliter
10,302,079 B2 5/2019 Kendrick
10,337,308 B2 7/2019 Broussard et al.
10,408,030 B2 9/2019 Oehring et al.
10,408,031 B2 9/2019 Oehring et al.
10,415,332 B2 9/2019 Morris et al.
10,526,882 B2 1/2020 Oehring et al.
10,648,270 B2 5/2020 Brunty et al.
10,648,311 B2 5/2020 Oehring et al.
10,686,301 B2 6/2020 Oehring et al.
10,690,131 B2 6/2020 Rashid et al.
10,731,561 B2 8/2020 Oehring et al.
10,740,730 B2 8/2020 Altamirano et al.
10,767,561 B2 9/2020 Brady
10,781,752 B2 9/2020 Kikkawa et al.
10,794,165 B2 10/2020 Fischer et al.
10,934,824 B2 3/2021 Oehring et al.
10,988,998 B2 4/2021 Fischer et al.
2001/0000996 A1 5/2001 Grimland et al.
2003/0057704 A1 3/2003 Baten et al.
2004/0045703 A1 3/2004 Hooper et al.
2004/0212679 A1 10/2004 Jun
2005/0116541 A1 6/2005 Seiver
2005/0201197 A1 9/2005 Duell et al.
2006/0109141 A1 5/2006 Huang
2007/0125544 A1 6/2007 Robinson et al.
2007/0201305 A1 8/2007 Heilman et al.
2008/0142304 A1 6/2008 Schutz et al.
2008/0164023 A1 7/2008 Dykstra et al.
2008/0217024 A1 9/2008 Moore
2008/0236818 A1 10/2008 Dykstra
2008/0257449 A1 10/2008 Weinstein et al.
2008/0277120 A1 11/2008 Hickie
2009/0068031 A1 3/2009 Gambier et al.
2009/0072645 A1 3/2009 Quere
2009/0078410 A1 3/2009 Krenek et al.
2009/0114392 A1 5/2009 Tolman et al.
2009/0200290 A1 8/2009 Cardinal et al.
2009/0315297 A1 12/2009 Nadeau et al.
2010/0193057 A1 8/2010 Garner et al.
2010/0281876 A1 11/2010 Khan et al.
2011/0042387 A1 2/2011 Henry et al.
2011/0061855 A1 3/2011 Case et al.
2011/0063942 A1 3/2011 Hagan et al.
2011/0081268 A1 4/2011 Ochoa et al.
2011/0097988 A1 4/2011 Lord
2011/0110793 A1 5/2011 Leugemors et al.
2011/0175397 A1 7/2011 Amrine, Jr. et al.
2011/0197988 A1 8/2011 Van Vliet et al.
2011/0209871 A1* 9/2011 Le ..... E21B 43/1195 166/297
2011/0241590 A1 10/2011 Horikoshi et al.
2012/0063936 A1 3/2012 Baxter et al.
2012/0111560 A1 5/2012 Hill et al.
2012/0112757 A1 5/2012 Vrankovic et al.
2012/0150455 A1* 6/2012 Franklin ..... G01M 3/243 702/114
2012/0255734 A1 10/2012 Coli et al.
2013/0051971 A1 2/2013 Wyse et al.
2013/0078114 A1 3/2013 Van Rijswick et al.
2013/0138254 A1 5/2013 Seals et al.
2013/0284455 A1 10/2013 Kajaria et al.
2013/0306322 A1 11/2013 Sanborn et al.
2014/0077607 A1 3/2014 Clarke et al.
2014/0124162 A1 5/2014 Leavitt
2014/0138079 A1 5/2014 Broussard et al.
2014/0158345 A1 6/2014 Jang et al.
2014/0174717 A1 6/2014 Broussard et al.
2014/0251623 A1 9/2014 Lestz et al.
2014/0273128 A1 9/2014 Coleman et al.

(56) References Cited

U.S. PATENT DOCUMENTS

| | | | | |
|---|---|---|---|---|
| 2015/0038021 | A1 | 2/2015 | Gilliam | |
| 2015/0114652 | A1 | 4/2015 | Lestz et al. | |
| 2015/0144336 | A1 | 5/2015 | Hardin et al. | |
| 2015/0147194 | A1 | 5/2015 | Foote | |
| 2015/0233530 | A1 | 8/2015 | Sandidge | |
| 2015/0252661 | A1 | 9/2015 | Glass | |
| 2016/0006311 | A1 | 1/2016 | Li | |
| 2016/0032703 | A1 | 2/2016 | Broussard et al. | |
| 2016/0177678 | A1 | 6/2016 | Morris et al. | |
| 2016/0230660 | A1 | 8/2016 | Zeitoun et al. | |
| 2016/0258267 | A1 | 9/2016 | Payne et al. | |
| 2016/0319649 | A1 | 11/2016 | Oehring | |
| 2016/0326853 | A1 | 11/2016 | Fred et al. | |
| 2016/0348479 | A1 | 12/2016 | Oehring et al. | |
| 2017/0082033 | A1 | 3/2017 | Wu et al. | |
| 2017/0096889 | A1* | 4/2017 | Blanckaert | E21B 43/128 |
| 2017/0204852 | A1 | 7/2017 | Barnett | |
| 2017/0212535 | A1 | 7/2017 | Shelman et al. | |
| 2017/0222409 | A1 | 8/2017 | Oehring et al. | |
| 2017/0226842 | A1 | 8/2017 | Omont et al. | |
| 2017/0292513 | A1* | 10/2017 | Haddad | F04B 49/065 |
| 2017/0370639 | A1 | 12/2017 | Barden et al. | |
| 2018/0090914 | A1 | 3/2018 | Johnson et al. | |
| 2018/0181830 | A1* | 6/2018 | Luharuka | G06K 9/6269 |
| 2018/0259080 | A1 | 9/2018 | Dale et al. | |
| 2018/0266217 | A1 | 9/2018 | Funkhauser et al. | |
| 2018/0284817 | A1 | 10/2018 | Cook et al. | |
| 2018/0298731 | A1 | 10/2018 | Bishop | |
| 2018/0312738 | A1 | 11/2018 | Rutsch et al. | |
| 2018/0313677 | A1 | 11/2018 | Warren et al. | |
| 2018/0363640 | A1 | 12/2018 | Kajita et al. | |
| 2018/0366950 | A1 | 12/2018 | Pedersen et al. | |
| 2019/0011066 | A1 | 1/2019 | Ungchusri et al. | |
| 2019/0040727 | A1 | 2/2019 | Oehring et al. | |
| 2019/0128104 | A1 | 5/2019 | Graham et al. | |
| 2019/0145251 | A1 | 5/2019 | Johnson | |
| 2019/0154020 | A1 | 5/2019 | Glass | |
| 2019/0249527 | A1 | 8/2019 | Kraynek | |
| 2019/0257462 | A1 | 8/2019 | Rogers | |
| 2020/0040878 | A1 | 2/2020 | Morris | |
| 2020/0325760 | A1 | 10/2020 | Markham | |
| 2020/0350790 | A1 | 11/2020 | Luft et al. | |

FOREIGN PATENT DOCUMENTS

| | | | | |
|---|---|---|---|---|
| CN | 112196508 | A | 1/2021 | |
| RU | 2450253 | C1 * | 5/2012 | G01M 99/00 |
| WO | 0047893 | A1 | 8/2000 | |
| WO | 2007055587 | A1 | 5/2007 | |
| WO | 2009046280 | | 4/2009 | |
| WO | 2012051705 | A1 | 4/2012 | |
| WO | WO-2013033547 | A1 * | 3/2013 | E21B 47/18 |
| WO | 201411676 | A1 | 7/2014 | |
| WO | 2014105642 | A1 | 7/2014 | |
| WO | 2014177346 | | 11/2014 | |
| WO | 2014177346 | A1 | 11/2014 | |
| WO | 2018044307 | A1 | 3/2018 | |
| WO | 2018213925 | A1 | 11/2018 | |
| WO | 2019210417 | | 11/2019 | |

OTHER PUBLICATIONS

Dan T. Ton & Merrill A. Smith, The U.S. Department of Energy's Microgrid Initiative, 25 The Electricity J. 84 (2012), pp. 84-94.

Non-Final Office Action issued in U.S. Appl. No. 16/871,328 mailed Dec. 9, 2021.

Non-Final Office Action issued in U.S. Appl. No. 16/943,935 mailed Oct. 21, 2021.

Non-Final Office Action issued in U.S. Appl. No. 16/564,186, mailed Oct. 15, 2021.

Final Office Action issued in U.S. Appl. No. 16/356,263 mailed Oct. 7, 2021.

Non-Final Office Action issued in U.S. Appl. No. 17/060,647 mailed Sep. 20, 2021.

Non-Final Office Action issued in U.S. Appl. No. 16/901,774 mailed Sep. 14, 2021.

Canadian Office Action issued in Canadian Application No. 3,094,768 mailed Oct. 28, 2021.

Morris et al., U.S. Appl. No. 62/526,869; Hydration-Blender Transport and Electric Power Distribution for Fracturing Operation; Jun. 28, 2018; USPTO; see entire document.

Final Office Action mailed Feb. 4, 2021 in U.S. Appl. No. 16/597,014.

International Search Report and Written Opinion mailed Feb. 4, 2021 in PCT/US20/59834.

International Search Report and Written Opinion mailed Feb. 2, 2021 in PCT/US20/58906.

International Search Report and Written Opinion mailed Feb. 3, 2021 in PCT/US20/58899.

Non-Final Office Action mailed Jan. 29, 2021 in U.S. Appl. No. 16/564,185.

Final Office Action mailed Jan. 21, 2021 in U.S. Appl. No. 16/458,696.

Final Office Action mailed Jan. 11, 2021 in U.S. Appl. No. 16/404,283.

Non-Final Office Action mailed Jan. 4, 2021 in U.S. Appl. No. 16/522,043.

International Search Report and Written Opinion mailed Dec. 14, 2020 in PCT/US2020/53980.

Non-Final Office Action issued in U.S. Appl. No. 16/871,928 mailed Aug. 25, 2021.

Non-Final Office Action issued in U.S. Appl. No. 16/943,727 mailed Aug. 3, 2021.

Non-Final Office Action issued in U.S. Appl. No. 14/881,525 mailed Jul. 21, 2021.

Non-Final Office Action issued in U.S. Appl. No. 16/404,283 mailed Jul. 21, 2021.

Notice of Allowance and Notice of Allowability issued in U.S. Appl. No. 15/829,419 mailed Jul. 26, 2021.

Woodbury et al., "Electrical Design Considerations for Drilling Rigs," IEEE Transactions on Industry Applications, vol. 1A-12, No. 4, Jul./Aug. 1976, pp. 421-431.

International Search Report and Written Opinion mailed in PCT/US20/67526 mailed May 6, 2021.

International Search Report and Written Opinion mailed in PCT/US20/67608 mailed Mar. 30, 2021.

International Search Report and Written Opinion mailed in PCT/US20/67528 mailed Mar. 19, 2021.

International Search Report and Written Opinion mailed in PCT/US20/67146 mailed Mar. 29, 2021.

International Search Report and Written Opinion mailed in PCT/US20/67523 mailed Mar. 22, 2021.

International Search Report and Written Opinion mailed in PCT/US2020/066543 mailed May 11, 2021.

Arvani et al., "Design and Development of an Engineering Drilling Simulator and Application for Offshore Drilling for MODUs and Deepwater Environments," Society of Petroleum Engineers, SPE-170301-MS, 2014, 17 pages.

Davis, "Natural Gas Finding Niche in E-Fracking, But Diesel Still Rules," Natural Gas Intelligence, NGI, 2019, 9 pages.

Shafto, "Growth in electric-fracking fleets stunted by tight producer budgets," S&P Global Market Intelligence, Aug. 6, 2019, 4 pages.

"Swivel Joint," Jereh, Yantal Jereh Petroleum Equipment & Technologies Co. Ltd., printed Dec. 1, 2022, 14 pages.

Camara, "Electrical Engineering Reference Manual for the Electrical and Computer PE Exam—Sixth Edition," Professional Publications, Inc., ISBN: 1-888577-56-8, 2002, 50 pages.

"Comprehensive Power, Power It Up," Technical Presentation, Feb. 27, 2013 (available at: https://www.slideshare.net/jeffsable/comprehensive-power-introduction-oct-2013?from_action=save), 28 pages.

"Comprehensive Power, Power It Up," Technical Presentation, Oct. 3, 2013 (available at: https://www.slideshare.net/jeffsable/comprehensive-power-introduction-oct-2013?from_action=save), 26 pages.

"American National Standard—Motors and Generators," ANSI/NEMA MG 1, 2011, 636 pages.

(56) References Cited

OTHER PUBLICATIONS

"IEEE Standard for Petroleum and Chemical Industry—Premium-Efficiency, Severe-Duty, Totally Enclosed Fan-Cooled (TEFC) Squirrel Cage Induction Motors—Up to and Including 370 KW (500 hp)," IEEE, 2009, 32 pages.
Cary et al., "Electric Rotating Machine Standards Part II: Magnetic Wedge Design & Monitoring Methods," IEEE, Paper No. PCIC-2011-41, 2011, 8 pages.
Bogh et al., "A User's Guide to Factory Testing of Large Motors: What Should Your Witness Expect?," IEEE, Paper No. PCIC-, 2009, 8 pages.
Lockley et al., "What do the API Motor/Generator Features Cost and What do They Buy You?," IEEE, Paper No. PCIC-2010-22, 2010, 10 pages.
Malinowski et al., "Petrochemical standards a comparison between IEEE 841-2001, API 541 and API 547," IEEE, Paper No. PCIC-2004-22, 2004, 8 pages.
"Reinventing the Frac Fleet," Clean Fleet, WhisperFrac Reducing Noise and Vibrations, 2018, 2 pages.
"MEC's Mobile Electric Centers for Voltages up to 36kV," ABB, printed 2021, 2 pages.
"Prefabricated Electric Centers (PEC)—Mobile Electric Centers (MEC)," Abb, 2017, 14 pages.
"Mobile Substations on wheels," ABB, 2022, 4 pages.
"Benefits of Using Mobile Transformers and Mobile Substations for Rapidly Restoring Electrical Service," U.S. Department of Energy, Aug. 2006, 48 pages.
"The Evolution of the Modern Substation," Primera, 2022, 4 pages.
Hanna et al., "Medium-Voltage Adjustable-Speed Drives—Users' and Manufacturers' Experiences," IEEE Transactions on Industry Applications, vol. 33, No. 6, Nov./Dec. 1997, 9 pages.
"IEEE 100: The Authoritative Dictionary of IEEE Standards Terms, Seventh Edition," IEEE Press, 2000, ISBN: 0-7381-2601-2, 7 pages.
"Adjustable Speed Electrical Power Drive Systems—Part 4: General Requirements—Rating Specifications for A.C. Power Drive Systems Above 1000 V A.C. and Not Exceeding 35 KV," National Electrical Manufacturers Association (NEMA) Standards Publication ICS 61800-4, 2004, 139 pages.
Roe, "Practices and Procedures of Industrial Electrical Design," McGraw-Hill, 1972, ISBN: 0-07-053390-3, 17 pages.
Oehring et al., U.S. Appl. No. 62/242,173, 2015, 17 pages.
Samsung All-In-One Security System, Quick Start Guide Kit Model SDHC5100, printed 2022, 11 pages.
Amazon.com listing for Samsung SDH-C5100 16 Channel 720p HD DVR Video Security System, 2015, 2 pages.
Amazon.com listing for Amcrest ProHD Wireless IP Security Camera, 2015, 8 pages.
Amazon.com listing for Security & Surveillance Cameras, 2015, 6 pages.
Stewart, "Extracting the Digit!! Time for an ROV Electronics Shake-Up?," Kongsberg Simrad Ltd, UTI, 1997, 10 pages.
Martin et al., "Lessons Learned from 27 Years' Experience of Stimulation Vessel Design and Operation—a Case Study," SPE 166243, 2013, 12 pages.
Maddox, "Visualizing Production in Flowing Oil Wells," Halliburton Energy Services, SPWLA 37th Annual Logging Symposium, Jun. 16-19, 1996, 6 pages.
Cooper et al., "The First Purpose-Built Stimulation Vessel for North Sea Application," Dowell Schlumberger, Society of Petroleum Engineers of AIME, SPE 12993, 1984, 7 pages.
Talley, "Development of a Closed Circuit TV Borehole Probe," Design Engineering Laboratories, Inc., Contract H0308041, Sep. 1984, 22 pages.
Smith et al., "Fracture Width-Design vs. Measurement," Amoco Production Co., Society of Petroleum Engineers of AIME, SPE 10965, 1982, 9 pages.
Hurst et al., "Development and Application of 'Frac' Treatments in the Permian Basin," SPE 405-G, vol. 204, 1955, 8 pages.
Briggs, "Development of a Downhole Television Camera," Oceanographic Engineering Corporation, 1964, 1 page.
IPIECA About US page, 2015, 1 page.
Appl et al., "A Viewing Lens for High Pressure Applications," Society of Petroleum Engineers of AIME, SPE-299, 1962, 7 pages.
Taylor, "Efficiency: Watchword of the Oil Industry," Financial Analysts Journal, 2018, 4 pages.
Pritchard, "U.S. Color Television Fundamentals: A Review," SMPTE Journal, Nov. 1977, vol. 86, 10 pages.
Moxastore website, listing for NPORTIA5250, 2015, 2 pages.
Moxastore website, About US, 2015, 1 page.
Moxastore website, Homepage, 2015, 2 pages.
Moxastore website, listing for Moxa 802.11 Ethernet to Serial, 2016, 1 page.
Amazon.com listing for Global Cache iTach, IP to Serial with PoE (IP2SL-P) by Global Cach, 2014, 3 pages.
Amazon.com listing for SainSmart TCP/IP Ethernet to Serial RS232 RS485 Intelligent Communication Converter by SainSmart, 2014, 4 pages.
Amazon.com listing for TCP/IP Ethernet to Serial RS232 RS485 RS422 Converter by Atc, 2014, 2 pages.
Amazon.com listing for StarTech.com 1 Port RS232 Serial to IP Ethernet Converter (NETRS2321P) by StarTech, 2014, 4 pages.
Amazon.com listing for StarTech NETRS2321E 1 Port RS-232/422/485 Serial over IP Ethernet Device Server by StarTech, 2014, 4 pages.
OSHA-NIOSH Hazard Alert: Worker Exposure to Silica during Hydraulic Fracturing, U.S. Department of Labor, 2012, 15 pages.
Avallone et al., "Marks Standard Handbook for Mechanical Engineers 11th Edition," McGraw-Hill, 2007, 5 pages.
Fink, "Standard Handbook for Electrical Engineers," Thirteenth Edition, McGraw-Hill, ISBN: 0-07-020984-7, 7 pages (excerpts) (Part 1).
Fink, "Standard Handbook for Electrical Engineers," Thirteenth Edition, McGraw-Hill, ISBN: 0-07-020984-7, 7 pages (excerpts) (Part 2).
Fink, "Standard Handbook for Electrical Engineers," Thirteenth Edition, McGraw-Hill, ISBN: 0-07-020984-7, 6 pages (excerpts) (Part 3).
Roe, "Practices and Procedures of Industrial Electrical Design," McGraw-Hill, 1972, ISBN: 0-07-053390-3, 14 pages (Part 1).
Roe, "Practices and Procedures of Industrial Electrical Design," McGraw-Hill, 1972, ISBN: 0-07-053390-3, 11 pages (Part 2).
Camara, "Electrical Engineering Reference Manual for the Electrical and Computer PE Exam—Sixth Edition," Professional Publications, Inc., ISBN: 1-888577-56-8, 2002, 17 pages (Part 1).
Camara, "Electrical Engineering Reference Manual for the Electrical and Computer PE Exam—Sixth Edition," Professional Publications, Inc., ISBN: 1-888577-56-8, 2002, 25 pages (Part 2).
Camara, "Electrical Engineering Reference Manual for the Electrical and Computer PE Exam—Sixth Edition," Professional Publications, Inc., ISBN: 1-888577-56-8, 2002, 20 pages (Part 3).
Camara, "Electrical Engineering Reference Manual for the Electrical and Computer PE Exam—Sixth Edition," Professional Publications, Inc., ISBN: 1-888577-56-8, 2002, 19 pages (Part 4).
Camara, "Electrical Engineering Reference Manual for the Electrical and Computer PE Exam—Sixth Edition," Professional Publications, Inc., ISBN: 1-888577-56-8, 2002, 21 pages (Part 5).
PPI Course Catalog, 2004, available at: https://web.archive.org/web/20040220012405/http://ppi2pass.com/catalog/servlet/MyPpi_fl_corner-catalog.pdf, 16 pages.
"Teaching an Electrical and Computer Engineering PE Exam Review Course," PPI, 2003, available at: https://web.archive.org/web/20031223100101/http://ppi2pass.com/catalog/servlet/MyPpi_pg_corner-teachee.html, 2 pages.
"Instructors Corner," PPI, 2003, available at: https://web.archive.org/web/20031219232547/http://ppi2pass.com/catalog/servlet/MyPpi_pg_corner-corner.html, 2 pages.
EE-Reference Online Index, 2004, available at: https://web.archive.org/web/20040731020344/http://ppi2pass.com/catalog/servlet/MyPpi_fl_indices-EERMindex.pdf, 41 pages.

(56) References Cited

OTHER PUBLICATIONS

EE-Reference Online Introduction, 2004, available at: https://web.archive.org/web/20041013101643/http://ppi2pass.com/catalog/servlet/MyPpi_fl_indices-EERMIntro.pdf, 12 pages.
"Electrical PE Exam Review Products," PPI Online Catalog, 2004, available at: https://web.archive.org/web/20040214233851/http://ppi2pass.com/catalog/servlet/MyPpi_ct_ELECTRICAL, 7 pages.
"The PPI Online Catalog," 2004, available at: https://web.archive.org/web/20040215142016/http://ppi2pass.com/catalog/servlet/MyPpi_ct_MAIN, 2 pages.
Homepage of Professional Publications, Inc., 2004, available at: https://web.archive.org/web/20040209054901/http:/ppi2pass.com/catalog/servlet/MyPpi, 1 page.
"What PPI Customers Say," 2003), available at: https://web.archive.org/web/20031226130924/http://ppi2pass.com/catalog/servlet/MyPpi_pg_comments-EEcomments.html, 2 pages.
"About PPI," 2003, available at: https://web.archive.org/web/20031219231426/http://ppi2pass.com:80/catalog/servlet/MyPpi_pg_aboutppi.html, 1 page.
Amazon.com listing of EE-Reference, 2007, available at: https://web.archive.org/web/20070103124447/https://www.amazon.com/Electrical-Engineering-Reference-Manual-Computer/dp/1888577568/, 7 pages.
Hampton, "Low-cost fracking offers boon to oil producers, headaches for suppliers," Reuters, Sep. 12, 2019, https://www.reuters.com/article/us-usa-oil-electric-fracturing-focus/low-cost-fracking-offers-boon-to-oil-producers-headaches-for-supplies, 11 page.
"All Electric Fracturing—Reducing Emissions and Cost," 2021, H013770, 6 pages.
Abbott et al., "Crippling the Innovation Economy: Regulatory Overreach at the Patent Office," Regulatory Transparency Project of the Federalist Society, Aug. 14, 2017, 35 pages.
"Hydraulic Fracturing Techbook," Hartenergy, 2015, 9 pages.
"Petroleum Alumnus and Team Development Mobile Fracturing Unit that Alleviates Environmental Impact," LSU College of Engineering, 2021, 2 pages.
"Clean Fleet Reduces Emissions by 99% at Hydraulic Fracturing Sites," FluidPower Journal, 2019, 5 pages.
Deuster, "Game-changing hydraulic fracturing technology, reduces emissions by 99%," Intrado GlobeNewswire, Oct. 1, 2014, 4 pages.
"Halliburton Delivers Successful Grid-Powered Frac Operation", Halliburton News Release, Jan. 14, 2021, 4 pages.
Wang et al., "Development In The Limited—Entry Completion Fracturing Technique," SPE 17834, 1988, 13 pages.
Holden III et al., "Successful Stimulation of Fordoche Field With a Retarded HF Acid," Society of Petroleum Engineers of AIME, Aug. 1981, 6 pages.
Milligan, "Sour Gas Well Completion Practices in the Foothills," Society of Petroleum Engineers of AIME, Sep. 1982, 12 pages.
Beck et al., "Reservoir Evaluation of Fractured Cretaceous Carbonates In South Texas," SPWLA Eighteenth Annual Logging Symposium, Jun. 5-8, 1977, 25 pages.
Webster, "Current Completion Practices in Tight Reservoirs," Society of Petroleum Engineers, SPE 6379, 1977, 8 pages.
Bielstein, "Wire-Line Methods and Equipment," Humble Oil and Refining Company, Apr. 2, 1967, 16 pages.
"Form-wound Squirrel-Cage Induction Motors—500 Horsepower and Larger," ANSI/API Standard, 541-2003, Fourth Edition, Jun. 2004, 88 pages.
Gardner Denver, "Well Servicing Pump, Model GD-2500Q, Quintuplex, Operating and Service Manual," 300FWF996 Revision C, Aug. 2005, 46 pages.
"Standard Specification for Steel Bars, Carbon and Alloy, Hot-Wrought, General Requirements for," ASTM Int;I, A 29/A 29M-05, 2005, 16 pages.
"Variable Speed Pumping: A Guide to Successful Applications," Elsevier 2004, ISBN 1-85617-449-2, 2004, 186 pages.
Bonnett et al., "Squirrel Cage Rotor Options for A.C. Induction Motors," IEEE, 2000, 14 pages.
Bonnett, "Root Cause Failure Analysis for AC Induction Motors in the Petroleum and Chemical Industry," IEEE, Paper No. PCIC-2010-43, 2010, 13 pages.
"Mark's Standard Handbook for Mechanical Engineers, 11th Edition," McGraw-Hill, ISBN 0-07-142867-4, 2006, 11 pages.
"Standard Handbook for Electrical Engineers," Thirteenth Edition, McGraw-Hill, ISBN 0-07-020984-7, 1993, 9 pages (Part 1).
"Standard Handbook for Electrical Engineers," Thirteenth Edition, McGraw-Hill, ISBN 0-07-020984-7, 1993, 7 pages (Part 2).
"Standard Handbook for Electrical Engineers," Thirteenth Edition, McGraw-Hill, ISBN 0-07-020984-7, 1993, 6 pages (Part 3).
"112 IEEE Standard Test Procedure for Polyphase Induction Motors and Generators," IEEE Power Engineering Society, IEEE Std 112, 2004, 42 pages (Part 1).
"112 IEEE Standard Test Procedure for Polyphase Induction Motors and Generators," IEEE Power Engineering Society, IEEE Std 112, 2004, 45 pages (Part 2).
Hodowanec et al., "Introduction to API Standard 541, 4th Edition—Form-Wound Squirrel Cage Induction Motors—Larger than 500 Horsepower," IEEE, Paper No. PCIC-2003-33, 2003, 9 pages.
Rahill et al., "Sorting Out the Overlap," IEEE Industry Applications Magazine, vol. 15, No. 1, Jan.-Feb. 2009, 12 pages.
"Manufacturers of Cushioned Clamping, Quick Coupling & Support Systems," ZSI Beta Clamps, ZSI, Inc., Apr. 29, 2015, 2 pages.
Meikrantz et al., "Advances in Liquid/Liquid Centrifuge Design Provide New Options for Petroleum Production," Society of Petroleum Engineers, SPE 56709, 1999, 4 pages.
Mistry et al., "Induction Motor Vibrations in View of the API 541—4th edition," IEEE, Paper No. PCIC-, 2008, 10 pages.
Paschall et al., "Navigating the Test Requirements of API 541 4th Edition," IEEE, Paper No. PCIC-2007-11, 2007, 12 pages.
"G7 Adjustable Speed Drive Operation Manual," Toshiba, Document No. 51546-009, Mar. 2005, 221 pages.
"Weir SPM: General Catalog," Weir SPM, 2009, 40 pages.
Krueger, "Advances in Well Completion and Stimulation During JPT's First Quarter Century," Journal of Petroleum Technology, Dec. 1973, 16 pages.
Lietard et al., "Hydraulic Fracturing of Horizontal Wells: An Update of Design and Execution Guidelines," Society of Petroleum Engineers, SPE 37122, 1996, 15 pages.
Waters et al., "Simultaneous Hydraulic Fracturing of Adjacent Horizontal Wells in the Woodford Shale," Society of Petroleum Engineers, SPE 119635, 2009, 22 pages.
Bahadori et al., "Dictionary of Oil, Gas, and Petrochemical Processing," CRC Press, ISBN: 978-1-4665-8825-7, 2014, 8 pages.
"A Dictionary for the Oil and Gas Company—Second Edition," The University of Texas at Austin—Petroleum Extension Service, ISBN: 978-0-88698-240-9, 2011, 7 pages.
"Lessons Learned from Natural Gas STAR Partners: Reduced Emissions Completions for Hydraulically Fractured Natural Gas Wells," U.S. Environmental Protection Agency, 2011, 12 pages.
Kidnay et al., "Fundamentals of Natural Gas Processing—Second Edition," CRS Press, ISBN: 978-1-4200-8519-8, 2011, 19 pages (Part 1).
Kidnay et al., "Fundamentals of Natural Gas Processing—Second Edition," CRS Press, ISBN: 978-1-4200-8519-8, 2011, 17 pages (Part 2).
Kidnay et al., "Fundamentals of Natural Gas Processing—Second Edition," CRS Press, ISBN: 978-1-4200-8519-8, 2011, 12 pages (Part 3).
Listing at Amazon.com for Kidnay et al., "Fundamentals of Natural Gas Processing—Second Edition," CRS Press, ISBN: 978-1-4200-8519-8, Jul. 7, 2013, 4 pages.
Listing at Amazon.com for Kidnay et al., "Fundamentals of Natural Gas Processing—Second Edition," CRS Press, ISBN: 978-1-4200-8519-8, Feb. 22, 2015, 4 pages.
"Green Completions," IPIECA, Jan. 20, 2015, 7 pages.
"Sand Trap FAQ," Mountain Equipment of New Mexico, Inc., Jan. 8, 2014, 2 pages.
"Test Separators FAQ," Mountain Equipment of New Mexico, Inc., Jan. 8, 2014, 2 pages.

(56) References Cited

OTHER PUBLICATIONS

"Emergency Power Systems for Critical Facilities: A Best Practices Approach to Improving Reliability," FEMA, FEMA P-1019. Sep. 2014, 170 pages.
Persily et al., "Indoor Environmental Issues in Disaster Resilience," NIST Technical Note 1882, Jul. 2015, 40 pages.
"Precision Heat and Control Systems for Onshore Drilling and Production," Chromalox Precision Heat and Control, 2011, 6 pages.
"Zeus Electric Pumping Unit," Halliburton, printed 2021, 4 pages.
Nayyar, "Piping Handbook—Seventh Edition," Piping Handbook, 1999, 77 pages.
"Wire Rope Isolator Technologies," ITT Enidine, Inc., Mar. 29, 2014, Enidine, 78 pages.
Gardner Denver, Well Servicing Pump, Model GD-2500Q, GD-2500Q-HD, Quintuplex Pumps, Super GWS Fluid End (Uni-Flange) Parts List, 310FWF997 Revision A, Sep. 2011, 45 pages.
Wachel et al., "Analysis of Vibration and Failure Problems in Reciprocating Triplex Pumps for Oil Pipelines," The American Society of Mechanical Engineers, 1985, 8 pages.
"Flowline Products and Services—World Proven Chiksan and Weco Equipment," FMC Technologies, Mar. 28, 2015, 31 pages (Part 1).
"Flowline Products and Services—World Proven Chiksan and Weco Equipment," FMC Technologies, Mar. 28, 2015, 49 pages (Part 2).
"A complete line of swivel joints for drilling, production, and well servicing," Chiksan Original Swivel Joints, Nov. 1996, 16 pages.
"Worlds Best Swivel Joints," FlowValve, Jan. 17, 2015, available at https://web.archive.org/web/20150117041757/http://www.flowvalve.com/swivels, 10 pages.
"Victualic Couplings—Vibration Attenuation Characteristics," Victaulic Company, Oct. 2014, 5 pages.
Hudson et al., "Modeling Victaulic Couplings in Piping Stress Analysis Programs," Victaulic Company, WP-18 6685 Rev. B, Mar. 19, 2013, 19 pages.
"AGS Flexible Coupling Style W77," Victaulic, Apr. 23, 2015, available at: https://web.archive.org/web/20150423052817/http:/www.victaulic.com/en/products-services/products/style-w77-ags-flexible-coupling/, 1 page.
"Advanced Groove System (AGS) Large Diameter Solutions." Victaulic, Apr. 19, 2015, available at: https://web.archive.org/web/20150419063052/http:/www.victaulic.com/en/businesses-solutions/solutions/advanced-groove-system/, 2 pages.
"Accommodating Seismic Movement," Victaulic, Apr. 12, 2015, available at https://web.archive.org/web/20150412042941/http:/www.victaulic.com/en/businesses-solutions/solutions/accommodating-seismic-movement/, 2 pages.
Saville, "The Victaulic Pipe Joint," Journal (American Water Works Association), Nov. 1922, vol. 9, No. 6, 8 pages.
Balaji et al., "Wire rope isolators for vibration isolation of equipment and structures," IP Conference Series: Materials Science and Engineering, 2015, 12 pages.
"FlowGuard Products," CoorsTek, Sep. 15, 2014 available at: https://web.archive.org/web/20140915230538/http://coorstek.com/resource-library/library/8510-1747-FlowGuard-Pulsation-Dampers.pdf, 8 pages.
"FlowGuard Pulsation Dampeners," CoorsTek, Feb. 23, 2015, available at: https://web.archive.org/web/20150223101630/http://www.coorstek.com/markets/energy_equipment/oil-gas/flowguard.php, 2 pages.
Morton, "Unlocking the Earth: A Short History of Hydraulic Fracturing," GEO ExPro, vol. 10, No. 6, Dec. 2013, 5 pages.
"Welcome to Stauff," Stauff, Aug. 5, 2013, 1 page.
"Stauff Clamps," Stauff, Aug. 7, 2013, 3 pages.
"Stauff Clamps, Heavy Series (DIN 3015-2)," Stauff, Aug. 30, 2013, 1 page.
"Heavy Series (DIN 3015-2)", Stauff, Product Literature, Nov. 3, 2013, 1 page.
"Heavy Series DIN 3015, Part 2," Stauff, Nov. 5, 2013, 24 pages.
Harris et al., "Harris' Shock and Vibration Handbook—Fifth Edition," McGraw-Hill Handbooks, 2002 [excerpted], 22 pages.
"Mark's Standard Handbook for Mechanical Engineers, 11th Edition," McGraw-Hill, ISBN 0-07-142867-4, 2007 [excerpted], 1 page.
Mallik et al., "On the Modelling of Non-Linear Elastomeric Vibration Isolators," Journal of Sound and Vibration, 1999, 219(2), 15 pages.
Malcius, "Mathematical model evaluation and parameter identification of pipe holder element," Journal of Vibroengineering, Jun. 2013, vol. 15, Issue 2, ISSN 1392-8716, 9 pages.
Wachel et al., "Piping Vibration Analysis," Engineering Dynamics, Incorporated, Proceedings of the Nineteenth Turbomachinery Symposium, 1990, 16 pages.

* cited by examiner

SYSTEMS AND METHODS FOR FLUID END HEALTH MONITORING

CROSS-REFERENCE TO RELATED APPLICATIONS

This application claims priority to and the benefit of U.S. Provisional Application No. 62/954,214, filed Dec. 27, 2019, titled "FLUID END HEALTH MONITORING USING DELTA PRESSURE", the full disclosure of which is incorporated herein by reference for all purposes.

FIELD OF INVENTION

This invention relates in general to hydraulic fracturing technology, and more particularly to monitoring the health of fluid ends.

BACKGROUND

With advancements in technology over the past few decades, the ability to reach unconventional sources of hydrocarbons has tremendously increased. Hydraulic fracturing technology has led to hydrocarbon production from previously unreachable shale formations. Hydraulic fracturing operations in oil and gas production involve the pumping of hydraulic fracturing fluids at high pressures and rates into a wellbore. The high pressure cracks the formation, allowing the fluid to enter the formation. Proppants, such as silica, are included in the fluid to wedge into the formation cracks to help maintain paths for oil and gas to escape the formation to be drawn to the surface. Hydraulic fracturing fluid can also typically contain acidic chemicals.

Due to the nature of hydraulic fracturing fluid, hydraulic fracturing pump fluid ends are subjected to harsh operating conditions. They pump abrasive slurries and acidic chemicals at high pressures and rates. Their lifespan is typically relatively short compared to other types of pumps. Maximizing fluid end lifespan is beneficial to the financial success of pressure pumping companies due at least in part to the high cost of fluid end replacement. Reducing the likelihood of fluid end failures also reduces maintenance costs and downtime.

SUMMARY OF THE INVENTION

In accordance with one or more embodiments, a method of hydraulic fracturing includes providing a fracturing fluid to a pump. The pump includes a pressure sensor for measuring pressure at a fluid end. The method further include injecting the fracturing fluid from the pump into a wellhead via the fluid end, obtaining a first pressure measurement at a discharge side of the fluid end via the pressure sensor, obtaining a second pressure measurement at the discharge side of the fluid end via the pressure sensor, determining a pressure differential between the first pressure measurement and the second pressure measurement, and determining an operational condition of the fluid end based at least in part on the pressure differential and a known or estimated correlation between the pressure differential and the operational condition. In some embodiments, the first pressure measurement and second pressure measurement are derived from a pressure sample taken by the pressure sensor over a period of time. In some embodiments, the first pressure measurement is the maximum value in the pressure sample and the second measurement is the minimum value in the pressure sample. In some embodiments, the first pressure measurement and the second measurement represent a pressure fluctuation in the pressure sample. In some embodiments, the operational condition includes an estimation of remaining life of the fluid end. In some embodiments, the estimation of remaining life is negatively correlated with the pressure differential. In some embodiments, the operational condition is determined based on one or more control system data in addition to the pressure differential.

In accordance with another embodiment, a method of monitoring a fluid end of a hydraulic fracturing pump includes obtaining a first pressure measurement at a discharge side of the fluid end via a pressure sensor, obtaining a second pressure measurement at the discharge side of the fluid end via the pressure sensor, determining a pressure differential between the first pressure measurement and the second pressure measurement, and determining an operational condition of the fluid end based at least in part on the pressure differential and a known or estimated correlation between the pressure differential and the operational condition. In some embodiments, the first pressure measurement and second pressure measurement are derived from a pressure sample taken by the pressure sensor over a period of time. In some embodiments, the first pressure measurement is the maximum value in the pressure sample and the second measurement is the minimum value in the pressure sample. In some embodiments, the first pressure measurement and the second measurement represent a pressure fluctuation in the pressure sample. In some embodiments, the operational condition includes an estimation of remaining life of the fluid end. In some embodiments, the pressure differential is negatively correlated with the estimation of remaining life. In some embodiments, the operational condition is determined based on one or more control system data in addition to the pressure differential.

In yet another example embodiment, a hydraulic fracturing system includes a pump comprising a fluid end, a pressure sensor positioned to measure pressure at a discharge side of the fluid end, and a control system. The control system is configured to: obtain a first pressure measurement at the discharge side of the fluid end via the pressure sensor, obtain a second pressure measurement at the discharge side of the fluid end via the pressure sensor, determine a pressure differential between the first pressure measurement and the second pressure measurement, and determine an operational condition of the fluid end based at least in part on the pressure differential and a known or estimated correlation between the pressure differential and the operational condition. In some embodiments, the pressure sensor is a high speed, high pressure transducer. In some embodiments, the first pressure measurement and second pressure measurement are derived from a pressure sample taken by the pressure sensor over a period of time. In some embodiments, the first pressure measurement is the maximum value in the pressure sample and the second measurement is the minimum value in the pressure sample. In some embodiments, the first pressure measurement and the second measurement represent a pressure fluctuation in the pressure sample. In some embodiments, the operational condition includes an estimation of remaining life of the fluid end.

DETAILED DESCRIPTION OF THE INVENTION

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. Additionally, recitations of steps of a method should be understood as being capable of being performed in any order unless specifically stated otherwise. Furthermore, the steps may be performed in series or in parallel unless specifically stated otherwise.

Figure 1:
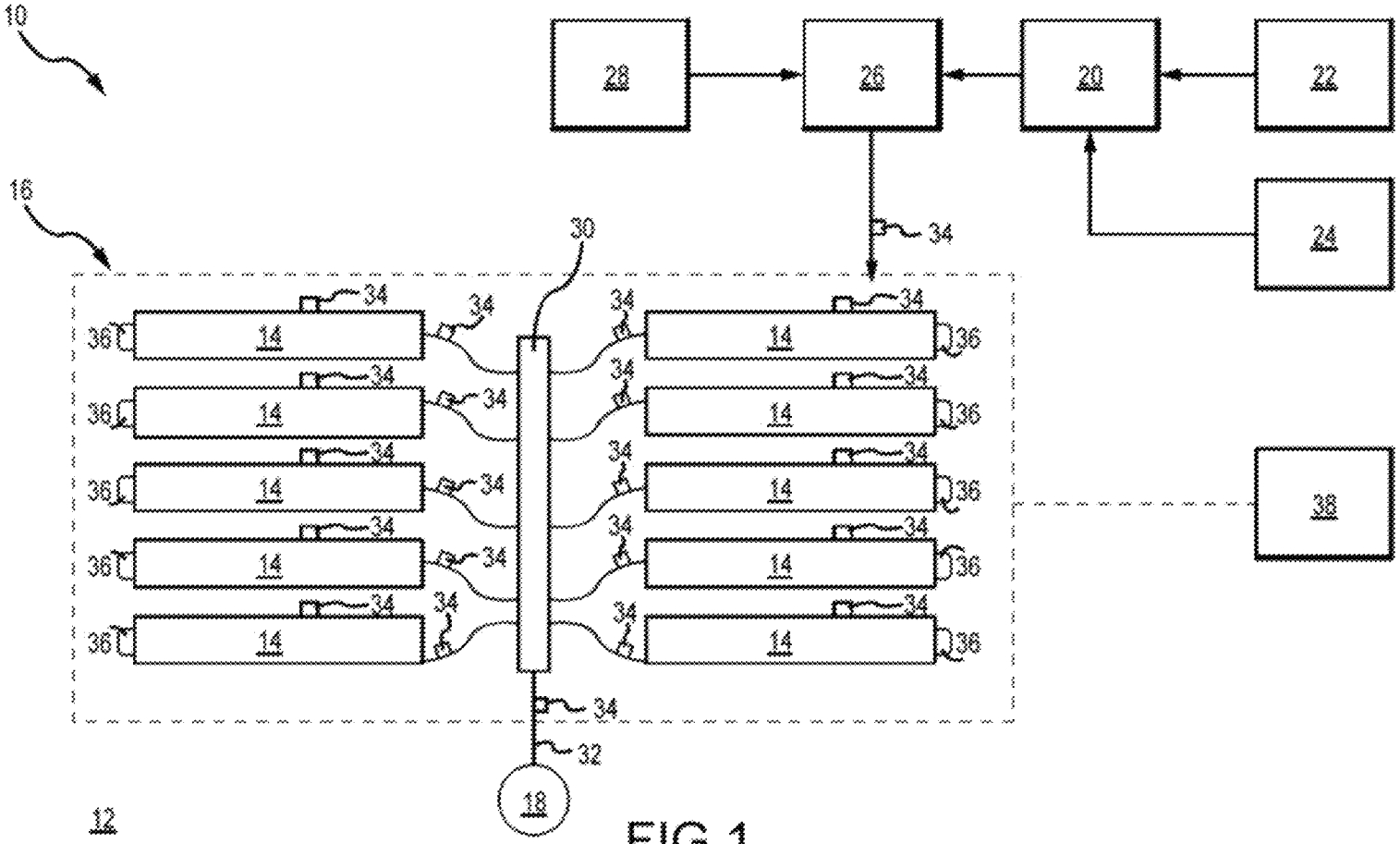
FIG. 1 is a schematic representation of an embodiment of a hydraulic fracturing system positioned at a well site.

FIG. 1 is a schematic representation of an embodiment of a hydraulic fracturing system 10 positioned at a well site 12. In the illustrated embodiment, pump trucks 14, which make up a pumping system 16, are used to pressurize a fracturing fluid solution for injection into a wellhead 18. A hydration unit 20 receives fluid from a fluid source 22 via a line, such as a tubular, and also receives additives from an additive source 24. In an embodiment, the fluid is water and the additives are mixed together and transferred to a blender unit 26 where proppant from a proppant source 28 may be added to form the fracturing fluid solution (e.g., fracturing fluid) which is transferred to the pumping system 16. The pump trucks 14 may receive the fracturing fluid solution at a first pressure (e.g., 80 psi to 100 psi) and boost the pressure to around 15,000 psi for injection into the wellhead 18. In certain embodiments, the pump trucks 14 are powered by electric motors.

After being discharged from the pump system 16, a distribution system 30, such as a missile, receives the fracturing fluid solution for injection into the wellhead 18. The distribution system 30 consolidates the fracturing fluid solution from each of the pump trucks 14 (for example, via common manifold for distribution of fluid to the pumps) and includes discharge piping 32 (which may be a series of discharge lines or a single discharge line) coupled to the wellhead 18. In this manner, pressurized solution for hydraulic fracturing may be injected into the wellhead 18. In the illustrated embodiment, one or more sensors 34, 36 are arranged throughout the hydraulic fracturing system 10. In embodiments, the sensors 34 transmit flow data to a data van 38 for collection and analysis, among other things.

Figure 2:
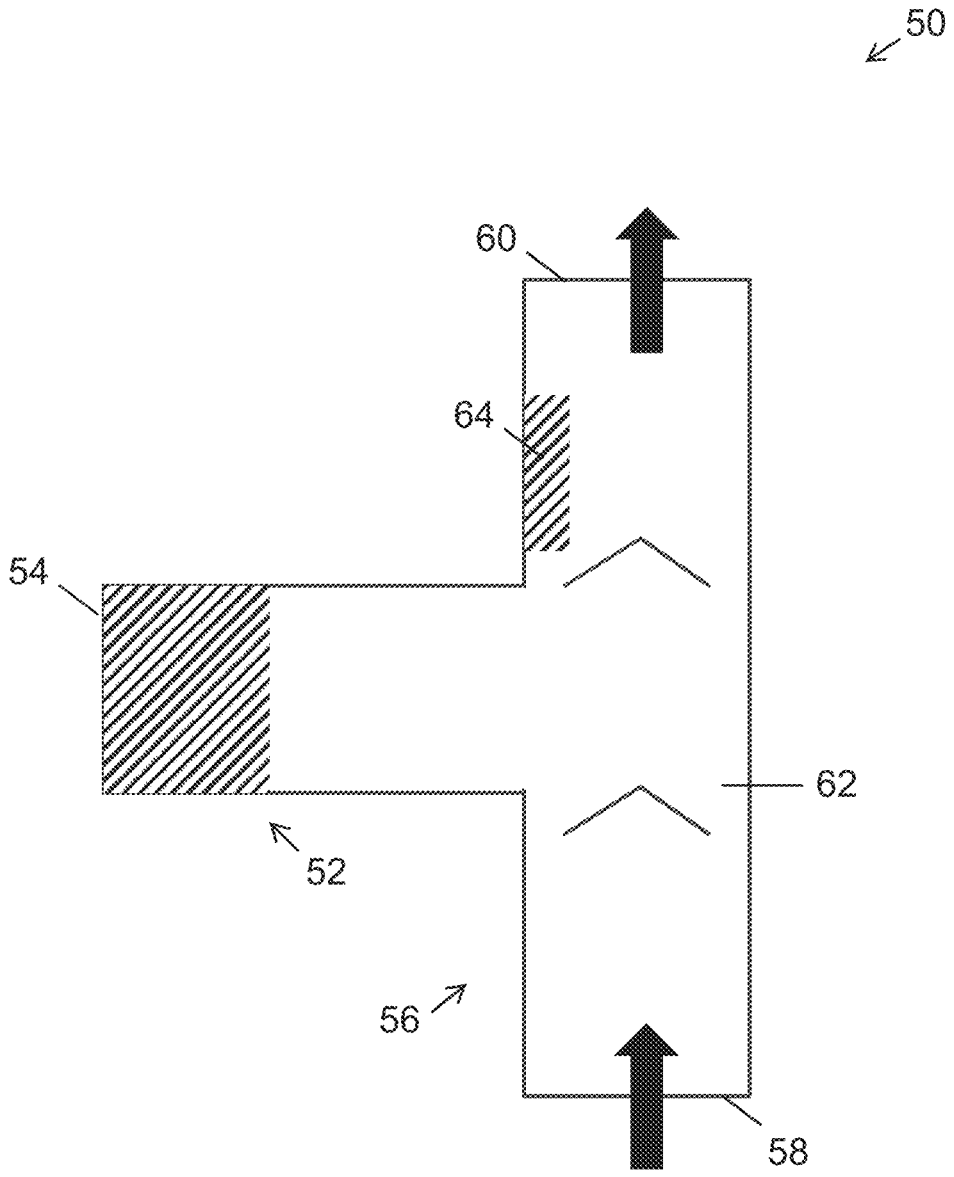
FIG. 2 is a simplified diagrammatical representation of a hydraulic fracturing pump, in accordance with example embodiments.

In some embodiments, the hydraulic fracturing system 10 includes hydraulic fracturing pumps that inject fracturing fluid into the wellhead. FIG. 2 is a simplified diagrammatical representation of a hydraulic fracturing pump 50, in accordance with example embodiments. The pump 50 typically includes a power end 52 which includes a displacement mechanism 54 that is moved to pump the fluid. The pump also includes a fluid end 56 through which the fluid moves. The fluid end 56 includes a suction side 58 where fluid is drawn in and a discharge side 60 where fluid is discharged from the pump 50. One or more pressure sensors 64 are positioned to measure pressure at the discharge side 60 of the fluid end 56. The one or more pressure sensors 64 may be a high speed, high pressure transducer. In some other embodiments, one or more pressure sensors 64 may be placed on the suction side 58, or at a chamber where a plunger would pressurize the fluid, or in a different area of the fluid end.

The fracturing system 10 also includes a control system. The control system is configured to obtain a first pressure measurement at the discharge side 60 of the fluid end 56 via the pressure sensor 64, obtain a second pressure measurement at the discharge side 60 of the fluid end 56 via the pressure sensor 64, determine a pressure differential between the first pressure measurement and the second pressure measurement, and determine an operational condition of the fluid end 56 based at least in part on the pressure differential and a known or estimated correlation between the pressure differential and the operational condition. In some embodiments, the first pressure measurement and second pressure measurement are derived from a pressure sample taken by the pressure sensor 64 over a period of time. In some embodiments, the first pressure measurement is the maximum value in the pressure sample and the second measurement is the minimum value in the pressure sample. In some embodiments, the first pressure measurement and the second measurement represent a pressure fluctuation in the pressure sample. In some embodiments, the operational condition includes an estimation of remaining life of the fluid end 56.

Hydraulic fracturing operations in oil and gas production require the pumping of hydraulic fracturing fluids at high pressures and rates into a wellbore. The high pressure cracks the formation, allowing the fluid to enter the formation. Proppants, such as silica, are included in the fluid to wedge into the formation cracks to help maintain paths for oil and gas to escape the formation to be drawn to the surface. Hydraulic fracturing fluid can also typically contain acidic chemicals.

Due to the nature of hydraulic fracturing fluid, hydraulic fracturing pump fluid ends are subjected to harsh operating conditions. Fluid ends pump abrasive slurries and acidic chemicals at high pressures and rates. The lifespan of a fluid end is typically relatively short compared to other types of pumps. Maximizing fluid end lifespan is beneficial to the financial success of pressure pumping companies due at least in part to the high cost of fluid end replacement. Fluid end failures modes or conditions may include, but are not limited to broken stayrod, cavitation, cracked fluid end, D-ring failure, iron bracket and pump iron issues, keeper or spring failure, loose packing nut, loose pony rod clamp, missing pony rod clamp, packing drip, packing failure, packing grease issues, pony rod clamp and packing nut impacting, sanded-off suction manifold, valve or seat cut, valve and seat wear, among others. Reducing the likelihood of fluid end failures also reduces maintenance costs and downtime, which is important to customers. Thus, being able to estimate remaining life of a fluid end can help avoid such failures.

The technology described herein utilizes using high speed, high pressure transducer(s) to determine the current running condition of the fluid end 56. This can be used to estimate or predict fluid end life expectancy. In some embodiments, by taking one individual pressure sample, the differential pressure is obtained by comparing the maximum and minimum values from that one data sample. This difference is known as delta pressure. As this variable grows larger and larger, the current operating health gets worse and the life of the asset is diminished. Thus, this can serve as a new process for monitoring fluid end health and life expectancy. It can be used in conjunction with control system data such as speeds, rates, pressures and well as with our vibration sensors that currently monitor fluid ends. Using the data from the pressure transducer to produce the delta pressure (i.e., pressure variance, pressure differential) is a critical and new metric for monitoring equipment health. Trending this data and correlating it to other variables results in new and yet to be determined equipment gains such as in efficiency, life, or redesign.

Figure 3:
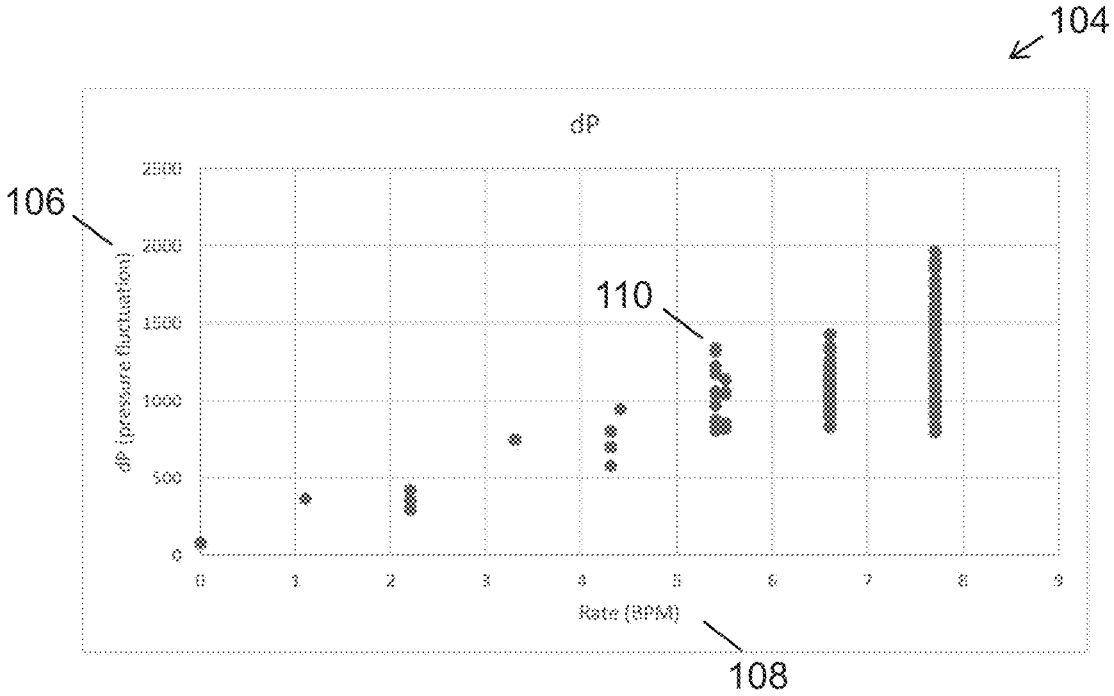
FIG. 3 is a chart illustrating data points of pump rate and pressure differential.
Figure 4:
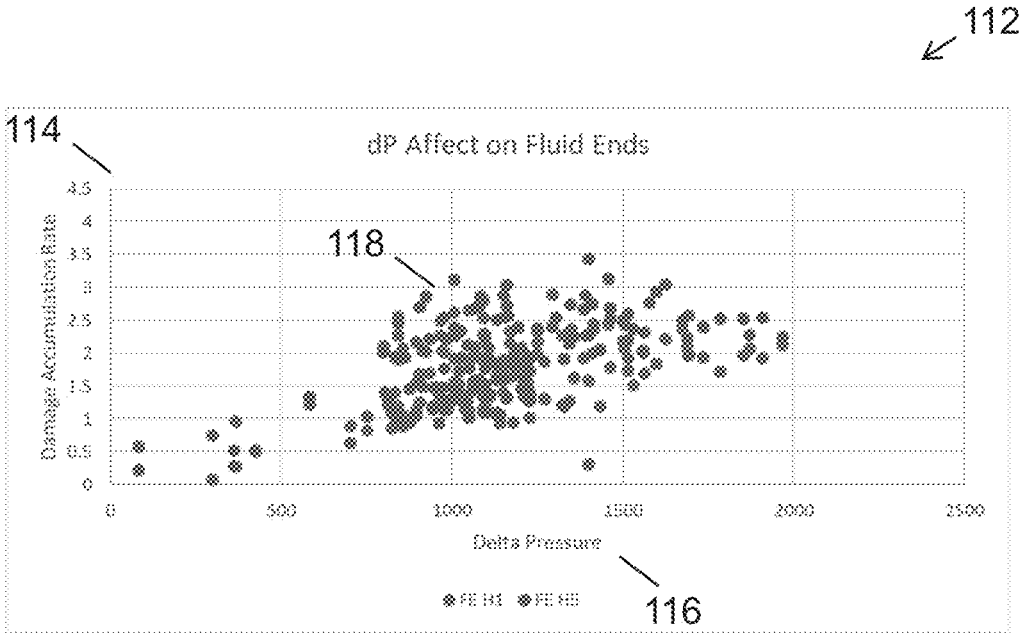
FIG. 4 is a chart illustrating data points of delta pressure and damage accumulation rate.

Delta pressure is a reading taken on the discharge side of the fluid end or downstream in the flow iron. This reading is associated with the pump rate (BPM). FIG. 3 is a chart 104 illustrating data points of pump rate 108 and pressure differential 106, otherwise referred to as delta pressure or pressure fluctuation. It can be observed from FIG. 3 that as pump rate 108 increases, generally so does the value of pressure differential 106. FIG. 4 is a chart 112 illustrating data points of delta pressure 116 and damage accumulation rate 114. In some embodiments, the damage accumulation rate 114 is captured using a vibration monitoring system. As shown, as delta pressure 116 increases, generally so does the associated damage accumulation rate 114. Thus, greater insight on equipment operating conditions and equipment health can be obtained by capturing delta pressure 116.

Using delta pressure may serve as a more accurate means of determining operating condition and equipment health, and encompasses a greater range of variables in determining operating condition and equipment health. It can serve as the main driver and leading indicator covering the various variables such as rate, pressure, cavitation, and other operating conditions that contribute to fluid end life. In some embodiments, existing transducer hardware may be used rather than adding on new hardware.

Certain embodiments of the present technology are directed to hydraulic fracturing pump fluid ends, but alternate embodiments contemplate use of the technology in other applications, including pump power ends (e.g., crosshead bearings, pinion bearings, gear wear), engines and transmissions, electric motors, power generation equipment, pump iron, and high pressure manifold systems such as single bore iron runs to wellheads.

In addition, data analysis and prediction can utilize a machine learning model. Training can be achieved by collecting all training and testing data into a database in the cloud. A headless Internet of Things (IoT) gateway can be onsite running custom software. This software captures data from various systems (e.g., control systems, GPS sensors, flowmeters, turbines, engines, transmissions, etc.) and forwards the data to an IoT hub in the cloud. Data about equipment lifespan, make/model, and maintenance history can be imported from an enterprise maintenance application via an application programming interface (API). Third-party data can also be imported via an API.

Cloud-based machine learning services can then use a subset of that data to train and test various models to determine the correlation between the various inputs and equipment lifespan. The resulting algorithm can then be deployed in the cloud or in the field, fed the necessary parameters in real time, and the results are displayed to users and continuously updated.

The present technology presents many advantages over known systems. For example, the system is able to determine the factors contributing to early equipment failure more accurately than current methods due to more comprehensive data collection. Other systems only rely on a small subset of contributing factors. The present technology is also capable of deploying the resulting prediction algorithm onsite, and providing it all the necessary parameters in real time. The ability to understand the factors that contribute to early equipment failure will result in new operating procedures that will extend the life of the equipment.

Figure 5:
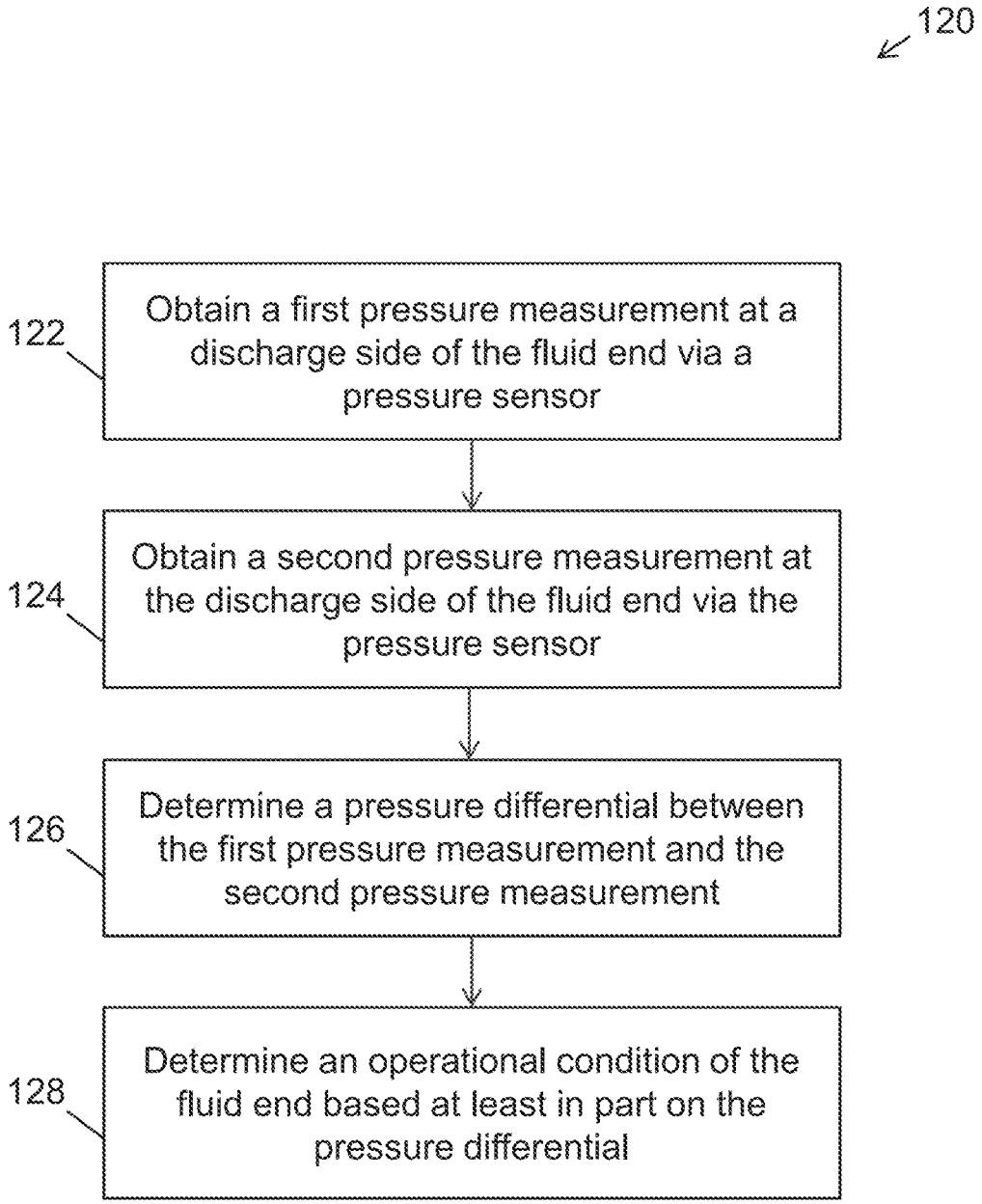
FIG. 5 is a flowchart illustrating a method of hydraulic fracturing, in accordance with example embodiments.

FIG. 5 is a flowchart illustrating a method 120 of hydraulic fracturing, in accordance with example embodiments. It should be noted that the method 120 may include additional steps, fewer steps, and differently ordered steps than illustrated in this example. In this example, a first pressure measurement at a discharge side is obtained (step 122) via a pressure sensor. A second pressure measurement at the discharge side is also obtained (step 124) via the pressure sensor. The first pressure measurement and second pressure measurement may be derived from a pressure sample taken by the pressure sensor over a period of time. In some embodiments, the first pressure measurement is the maximum value in the pressure sample and the second measurement is the minimum value in the pressure sample. In some embodiments, the first pressure measurement and the second measurement represent a pressure fluctuation in the pressure sample. A pressure differential between the first pressure measurement and the second pressure measurement is determined (step 126). An operational condition of the fluid end, such as health or impending failure, is then determined (step 128) based at least in part on the pressure differential. In some embodiments, the operational condition includes an estimation of remaining life of the fluid end. In some embodiments, the pressure differential is negatively correlated with the estimation of remaining life. In some embodiments, the operational condition is determined based on one or more control system data in addition to the pressure differential.

Figure 6:
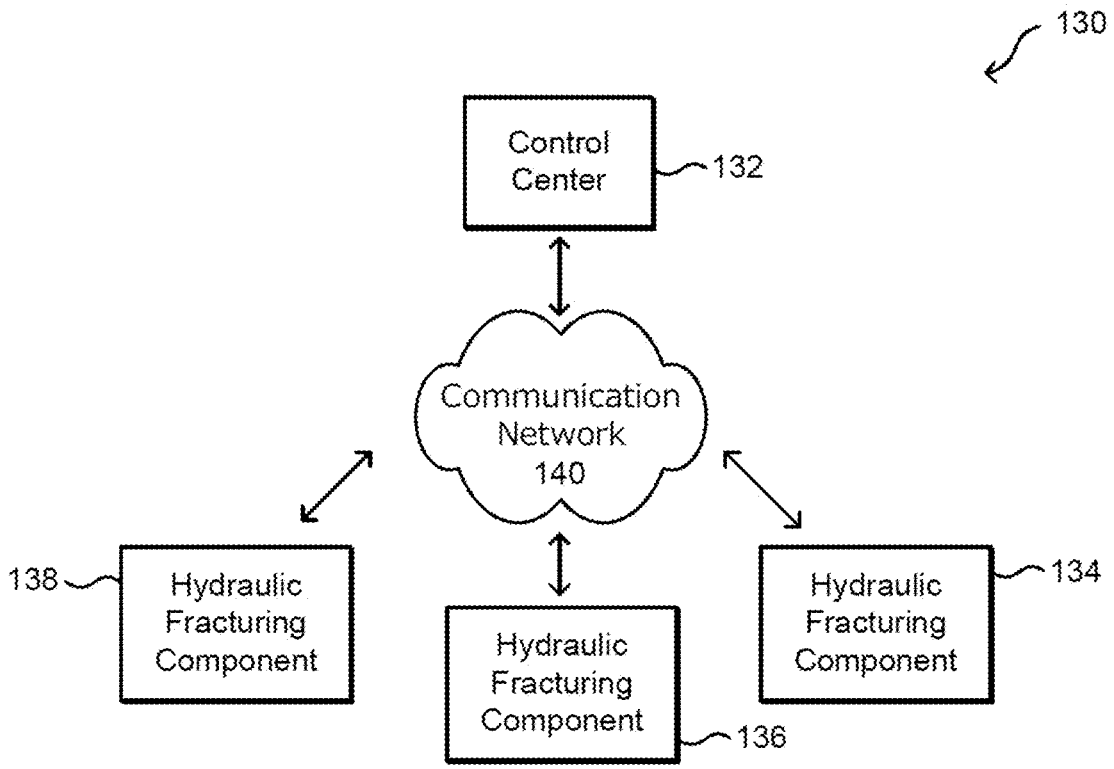
FIG. 6 includes a diagram illustrating a communications network of the automated fracturing system, in accordance with various embodiments.

FIG. 6 includes a diagram 130 illustrating a communications network of the automated fracturing system, in accordance with various embodiments. In this example, one or more hydraulic fracturing components 138, such as, and not limited to, any of those mentioned above, may be communicative with each other via a communication network 140 such as described above with respect to FIG. 3. The components 138 may also be communicative with a control center 132 over the communication network 140. The control center 132 may be instrumented into the hydraulic fracturing system or a component. The control center 132 may be onsite, in a data van, or located remotely. The control center 132 may receive data from any of the components 138, analyze the received data, and generate control instructions for one or more of the components based at least in part on the data. For example, the control center 132 may control an aspect of one component based on a condition of another component. In some embodiments, the control center 140 may also include a user interface, including a display for displaying data and conditions of the hydraulic fracturing system. The user interface may also enable an operator to input control instructions for the components 134. The control center 140 may also transmit data to other locations and generate alerts and notification at the control center 140 or to be received at user device remote from the control center 140.

Alternate embodiments of the present technology may incorporate the use of alternative cloud services, cloud service providers, or methods of communicating the data from the field (e.g., cellular, satellite, wireless) to accomplish the same ends discussed above. In addition, the machine learning model(s) may be embedded on equipment onsite, such as the various control systems controllers, one of the PCs, or in the IoT gateway. Furthermore, methods other than machine learning may be used to create the prediction algorithms.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A method of hydraulic fracturing, comprising:

providing a fracturing fluid to a pump, the pump comprising a pressure sensor for measuring pressure at a fluid end;

injecting the fracturing fluid from the pump into a wellhead via the fluid end;

obtaining a first pressure measurement at the fluid end via the pressure sensor;

obtaining a second pressure measurement at the fluid end via the pressure sensor;

determining a pressure differential between the first pressure measurement and the second pressure measurement, wherein the first pressure measurement and second pressure measurement are derived from a pressure sample taken by the pressure sensor over a period of time, and wherein the first pressure measurement is the maximum value in the pressure sample and the second pressure measurement is the minimum value in the pressure sample; and determining an operational condition of the fluid end based at least in part on the pressure differential and a known or estimated correlation between the pressure differential and the operational condition, wherein the operational condition includes an estimation of remaining life of the fluid end.

2. The method of claim 1, wherein the pressure differential is negatively correlated with the estimation of remaining life.

3. The method of claim 1, wherein the first and second pressure measurements are taken at a discharge side, a suction side, or a plunger chamber of the fluid end.

4. A method of monitoring a fluid end of a hydraulic fracturing pump, comprising:

obtaining a first pressure measurement at the fluid end via a pressure sensor;

obtaining a second pressure measurement at the fluid end via the pressure sensor;

determining a pressure differential between the first pressure measurement and the second pressure measurement, wherein the first pressure measurement and second pressure measurement are derived from a pressure sample taken by the pressure sensor over a period of time, and wherein the first pressure measurement is the maximum value in the pressure sample and the second pressure measurement is the minimum value in the pressure sample; and determining an operational condition of the fluid end based at least in part on the pressure differential and a known or estimated correlation between the pressure differential and the operational condition, wherein the operational condition includes an estimation of remaining life of the fluid end.

5. The method of claim 4, wherein the first and second pressure measurements are taken at a discharge side, a suction side, or a plunger chamber of the fluid end.

6. The method of claim 4, wherein the pressure differential is negatively correlated with the estimation of remaining life.

7. The method of claim 4, wherein the operational condition is determined based on one or more control system data in addition to the pressure differential.

8. The method of claim 7, wherein the control system data comprises at least one of speed data, rate data, pressure data, and vibration data, wherein the vibration data is produced by one or more vibration sensors that are coupled to the fluid end.

9. A hydraulic fracturing system comprising: a pump comprising a fluid end;

a pressure sensor positioned to measure pressure at the fluid end; and a control system, the control system configured to:

obtain a first pressure measurement at the fluid end via the pressure sensor;

obtain a second pressure measurement at the fluid end via the pressure sensor;

determine a pressure differential between the first pressure measurement and the second pressure measurement, wherein the first pressure measurement and second pressure measurement are derived from a pressure sample taken by the pressure sensor over a period of time, and wherein the first pressure measurement is the maximum value in the pressure sample and the second pressure measurement is the minimum value in the pressure sample; and determine an operational condition of the fluid end based at least in part on the pressure differential and a known or estimated correlation between the pressure differential and the operational condition, wherein the operational condition includes an estimation of remaining life of the fluid end.

10. The hydraulic fracturing system of claim 9, wherein an increase in the pressure differential indicates a decrease in the estimation of remaining life of the fluid end.

* * * * *